US006629335B1

(12) United States Patent
Derman

(10) Patent No.: US 6,629,335 B1
(45) Date of Patent: Oct. 7, 2003

(54) ADJUSTABLE GRIP, CLASPING DEVICE

(76) Inventor: Jay S. Derman, P.O. Box 3823, Palos Verdes, CA (US) 90274-9533

( * ) Notice: Subject to any disclaimer, the term of this patent is extended or adjusted under 35 U.S.C. 154(b) by 88 days.

(21) Appl. No.: 10/061,745

(22) Filed: Feb. 4, 2002

(51) Int. Cl.[7] ..... E05F 5/06

(52) U.S. Cl. ..... 16/85; 16/82; 292/70; 292/DIG. 60

(58) Field of Search ..... 16/85, 86 B, 86 A, 16/82; 292/70, 17, 19, DIG. 38, DIG. 60, 254; 411/14.5, 338, 339, 512; 24/DIG. 60, 595.1, 594.11, 578.13, 627

(56) References Cited

U.S. PATENT DOCUMENTS 951,817 A * 3/1910 Hendricks ..... 292/17
2,885,237 A * 5/1959 Heyer ..... 292/70
3,061,346 A * 10/1962 Jorgensen ..... 292/17
3,180,666 A * 4/1965 Jorgensen ..... 292/70
3,228,717 A * 1/1966 Waller et al. ..... 292/70
3,243,836 A * 4/1966 Reiss ..... 16/85
3,675,959 A * 7/1972 Hansen et al. ..... 292/70
4,121,319 A * 10/1978 Welch ..... 16/66
4,276,806 A * 7/1981 Morel ..... 411/41
4,402,116 A * 9/1983 Schenck ..... 24/662
4,408,372 A * 10/1983 Kimura et al. ..... 24/662
4,874,276 A * 10/1989 Iguchi ..... 411/48

* cited by examiner

*Primary Examiner*—Gary Estremsky
*Assistant Examiner*—Mark Williams
(74) *Attorney, Agent, or Firm*—Monty Koslover

(57) ABSTRACT

An adjustable grip clasping device which comprises a post and a catch that clasps the post to hold an entry door open or a cabinet door closed. The catch may be mounted on a door and the post mounted in a door frame or wall baseboard, or the positions reversed. The catch utilizes a clamshell-like clasping mechanism to grip the post, and includes provision for a manual adjustment of the strength of the catch grip to suit an acceptable pull strength for release of the post from the catch. The device is inexpensive to produce, and readily adaptable for a broad range of clasping applications that include temporarily holding and securing light weight objects.

4 Claims, 2 Drawing Sheets

ADJUSTABLE GRIP, CLASPING DEVICE

BACKGROUND OF THE INVENTION

1. Field of the Invention

This invention relates to clasping devices and more particularly, to devices for removably clasping a door or a panel in an open or closed position.

2. Background

There presently exist a number of different devices for holding an entry door open or temporarily holding a cabinet door closed. Some of these devices utilize a magnetic catch for placement on a door which engages a post or plate that is attached to a wall or door frame. Others use forms of mechanical clasping elements as a catch to clasp a member that is attached to an opposing surface.

None of these devices are known to include a capability of easy manual adjustment of the grasping pressure or force applied by a catch to a post. A need for this adjustment capability presently exists for all entry door and cabinet door applications that involve safety considerations, particularly where small children may have access to the doors. Further, many of the currently available devices are highly specialized for use with doors and can not be readily adapted for other temporary grasping needs. This limits their use to few applications.

There is therefore a need for a simple clasping device that incorporates an adjustable grip, for use in temporarily holding entry and cabinet doors open or closed. It would also be helpful if such a device was relatively universal in its applications, compared with presently available clasping devices.

SUMMARY OF THE INVENTION

The invention is an adjustable grip, clasping device that may be used for a number of different applications. A preferred embodiment of the invention device is described as being applied for holding an entry door open or holding a cabinet door closed. The device comprises two separate elements; a catch that may be attached to a door and a post that may be mounted in a door frame or to a wall baseboard. The catch and post positions may be reversed, depending on the application. The catch utilizes a clamshell-like clasping mechanism to grip the post, and includes provision for manual adjustment of the catch grip strength to suit an acceptable pull strength to release the post from the catch. The device is adaptable for a broad number of applications and is inexpensive to produce.

Accordingly, it is a prime object of the present invention to provide an adjustable grip, clasping device for holding entry doors open or cabinet doors closed.

Another object of this invention is to provide a clasping device that may be readily adapted to various applications other than doors.

A prime advantage of this device over competing door holding devices is its easy manual adjustment of the catch grip on a mating post.

Further objects and advantages of the invention will be apparent from studying the following portion of the specification, the claims and the attached drawings.

DESCRIPTION OF THE PREFERRED EMBODIMENT

The invention is an adjustable grip, clasping device which may be typically applied to holding an entrance door open or keeping a cabinet door closed, including also many other applications.

Figure 1:
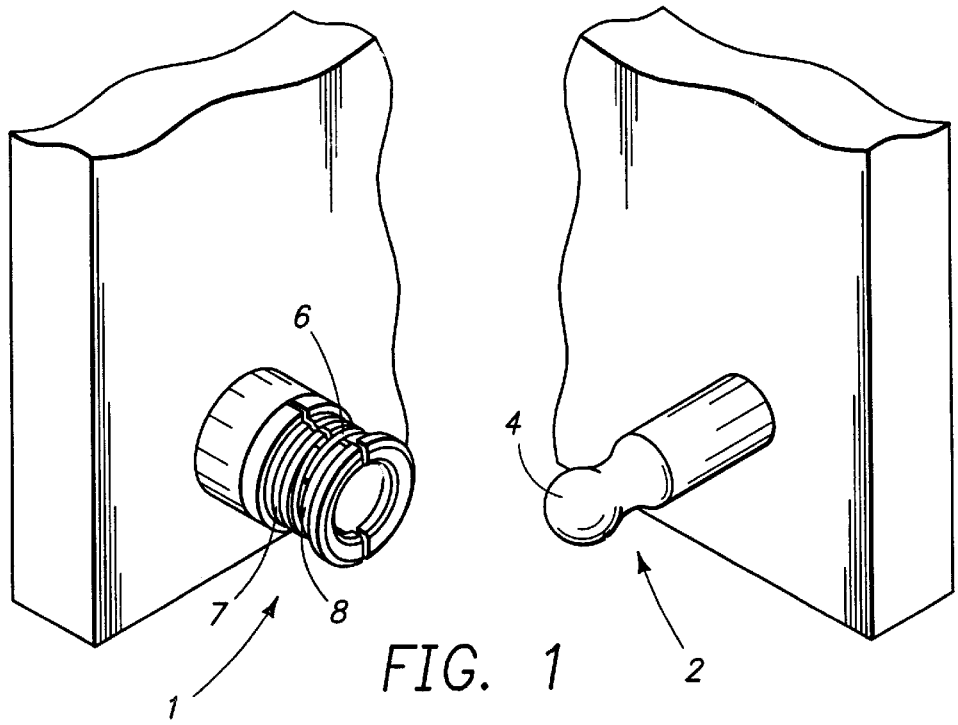
FIG. 1 is a perspective view of a preferred embodiment of the present invention clasping device, particularly showing a catch installed on a door and ready to clasp the end of a post that is installed opposite on a wall.

As shown in FIG. 1, the preferred embodiment of the device comprises two elements: a receiver catch 1 and a post 2, with both elements designed to engage the other. Either the catch 1 or post 2 may be mounted on a door and the other element mounted opposite on a wall or other opposing surface. In use, as the door is fully opened, the knob 4 at the end of the post 2 penetrates the end opening of the catch 1, until the knob 4 is enclosed and grasped by an internal circular ridge in the end opening of the catch 1.

Installation of the invention device is easier than for currently available door holding devices. This is because the catch 1 and post 2 do not need to be exactly aligned. The knob 4 end of the post and the flexible opening of the catch 1 allows for minor degrees of misalignment.

The catch 1 comprises a base member 12, a cylindrical, split collar 8 with grooves 7 cut in its circumference, a spring clasp 6 that fits around the collar 8 in a groove 7 and a fastening screw 17.

The degree of gripping pressure applied by the catch 1 to the post 2 may be adjusted to be loose or tight as required. This is done by manually positioning the spring clasp 6 in a groove 7 which is located nearer to or further away from the catch 1 opening end. Positioning the spring clasp 6 in a groove 7 nearer to the catch opening, will bring the end of the two sections of the collar 8 closer together, exerting more pressure on the knob of the post 2 in a clamshell-like action. This adjustment capability is the most important attribute of the device, providing simple manual adjustment of the catch grasping pressure. Thus, if an entry door needed to be held firmly open to avoid being blown shut by a sudden wind, the catch spring clasp 6 would be adjusted to exert the maximum pressure before pushing the door in place. For normal use, the catch spring clasp 6 would be set for moderate or light applied pressure.

Another use could be the installation of the invention device on a cabinet door to secure the door from being opened by a young child. For this application, the device elements would be small in size and partly inset in a cabinet door and its opposing stop surface. Adjusting the catch spring clasp for maximum pressure will produce a device grip too strong for a young child to overcome, yet practical for an adult.

Figure 3:
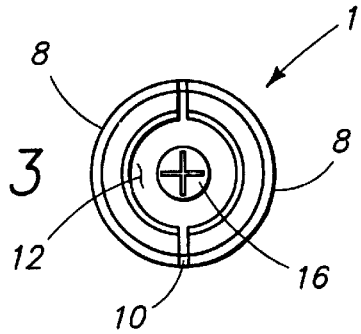
FIG. 3 is a top end view of the assembled catch, particularly showing the central end opening into the catch and the head of a fastening screw.
Figure 2:
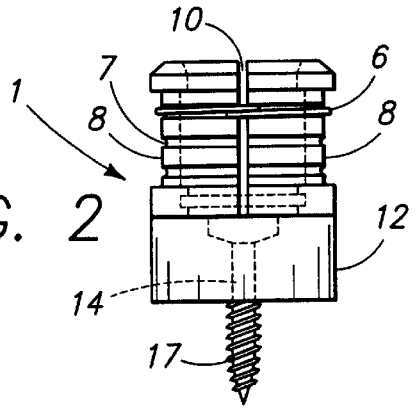
FIG. 2 is a side elevation view of an assembled catch, according to the present invention.

Refer now to FIGS. 2 and 3 which are respectively, a side elevation view of an assembled catch 1 and a top end view of the catch 1, according to the present invention.

Two split collar 8 sections are mounted on the base member 12, with their bottom portion engaging a concentric rim flange which is located on a stepped upper portion of the base member 12. Several separate grooves 7 are cut in the periphery of the collar sections for adjusting the position of the spring clasp 6 on the collar 8.

The split collar sections, when mounted and held together, create a cavity above the base member 12, having an opening at the top end of the catch 1. Because of the attached spring clasp 6, the catch opening is flexible and able to be forced open sufficient to permit insertion of the knob 4 into the opening and internal cavity.

The collar mounting method also creates a longitudinal space or slot 10 between the matching ends of the collar 8 sections. This slot 10 and the collar base flange mounting, facilitate a clamshell-like movement of the collar 8, which can be made to pivot around the base member flange at one end and close the slot 10 at the catch open end. The more the slot space is narrowed, the greater will be the applied grip of the collar opening on the side of an enclosed post knob 4.

The spring clasp 6 performs two functions. These are holding the collar 8 sections to the base member 12, and providing for an adjustment of the pressure applied by the collar opening ridge to any inserted post knob 4. These functions may also be performed by any suitably sized radially expansible and contractable means such as a tightly wound annular spring.

The base member 12 includes provision for seating the head 16 of a fastening screw 17. In the illustration of FIG. 2, the screw is a wood screw intended for fastening the catch to a wood door or wall surface. However, it could have instead been a machine screw and used with a nut to fasten the catch to a metal panel or door.

Figure 4:
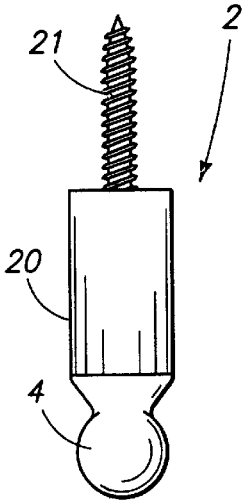
FIG. 4 is an elevation view of a post according to the present invention, particularly showing an attached wood screw to be used for fastening the post to a wood surface material.
Figure 5:
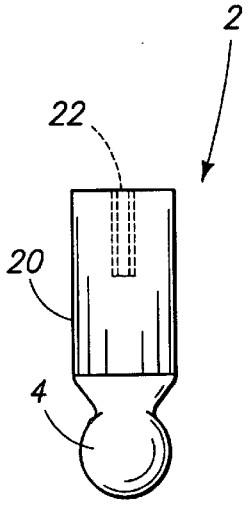
FIG. 5 is an elevation view of an alternate post according to the present invention, particularly showing an axial threaded hole in one end for use with a machine screw fastener for fastening the post to a given surface.

Refer now to FIGS. 4 and 5 which depict alternate embodiments of the invention post 2. FIG. 4 is a side elevation view of a post 2 that could be used with a wooden door or wall base. The post 2 includes an attached, embedded screw 21 for fastening the post body 20 to an appropriate surface. The post body 20 may be made very short in length if necessary for its intended use. For entry door use, the body 20 would need to be long to allow clearance for an entry door knob.

FIG. 5 shows a post 2 that does not include an attached fastening screw. Instead, the post body 20 incorporates an axial threaded hole 22 in its end, providing for a machine screw fastening.

A post 2 of the configuration shown in FIG. 5 would probably be used primarily with metal doors or panels, although it could be used with wooden doors or panels that permit through holes for fasteners.

Figure 6:
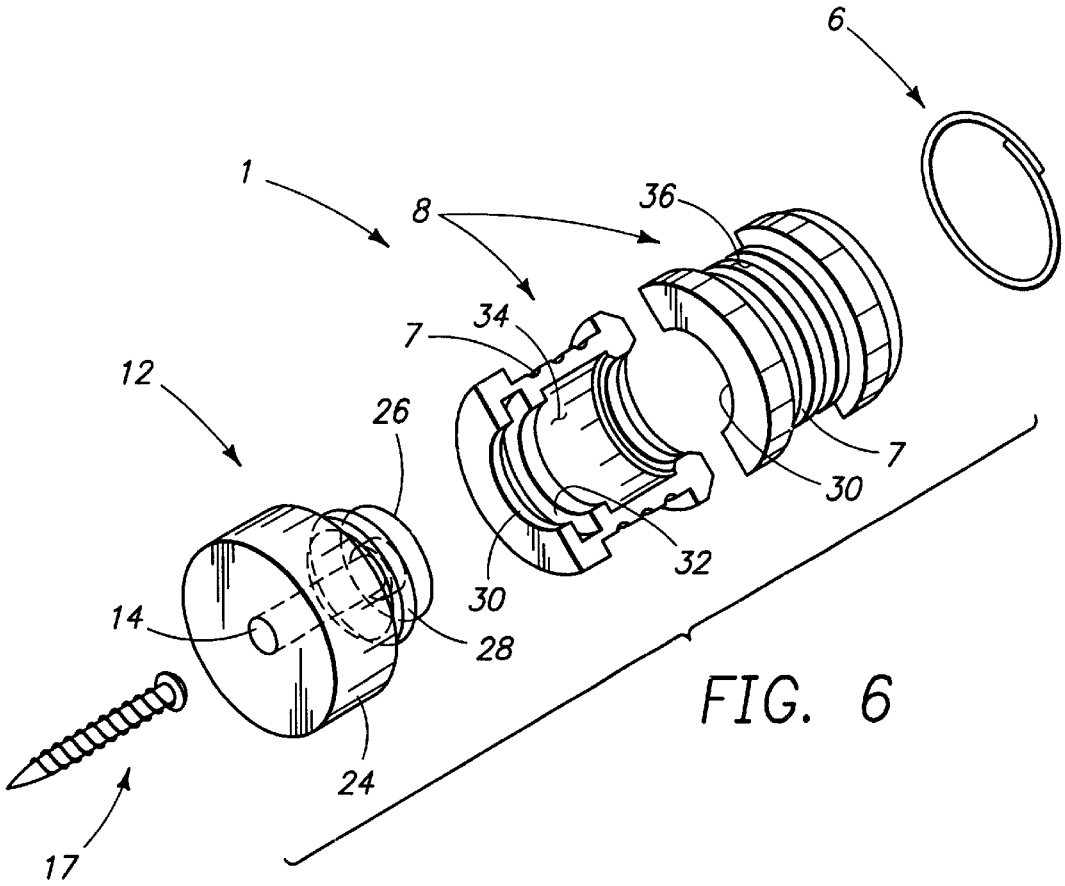
FIG. 6 is an exploded view of the catch.

Refer now to FIG. 6 which is an exploded view of the catch 1. The spring clasp 6 is in the form of a common steel split-ring with one helical turn. This is the simplest form of the radially expansible means needed to hold the two sections of the collar 8 together. As can be seen, the collar 8 sections have substantial stepped projecting portions that encircle both ends of the collar 8 inner surface 34 and outer surface 36. The inner surface 34 becomes the wall of a cavity for enclosing a post knob 4. The spring clasp 6 fits over the collar outer surface 36 and is manually adjusted to fit in one of the peripheral grooves 7 as needed.

The end stepped projections of the collar 8 sections define the collar opening 30 diameter at both ends, and includes a deep internal groove 32 encircling one end of the collar for mounting to the base member 12.

The base member 12 is cylindrical in shape, having a lower portion 24, a concentric, stepped upper portion 26 and a flange 28 that encircles the upper portion 26. An axial through hole 14, having a recessed entry in the top surface of the upper portion 26 is provided for a fastening screw 17.

Figure 7:
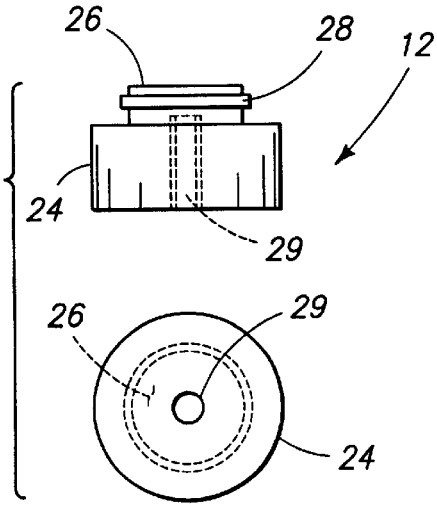
FIG. 7 is a side elevation view and bottom plan view of the catch base member.

Refer now to FIG. 7 which shows a side elevation view and a bottom plan view of the base member 12. The flange 28 is sized and positioned to fit and engage the circumferential groove 32 in the collar 8 sections when the two collar parts are placed on the base member. Thus, the two collar sections are retained by the flange 28 which also provides a pivot for the collar clamshell-like closing action.

In FIG. 7, a threaded fastening hole 29 is shown in the base member 12 rather than the through hole 14 shown in FIG. 6. This axial threaded hole 29 for a machine screw, is included as illustrating an alternate fastening means for fastening the catch 1 to a wall or door.

Figure 8:
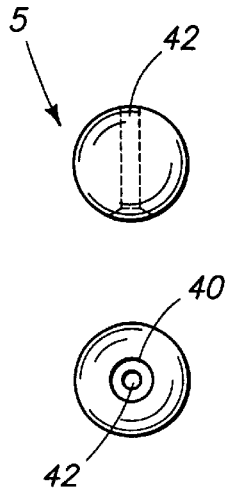
FIG. 8 is a side elevation view and end view of a spherical knob which is a second alternate post according to the present invention.

Refer now to FIG. 8. This shows an elevation view and an end view of a knob 5 that together with a fastening screw performs the functions of a post. A hole 42 having a recessed end 42 to receive a fastening screw, is cut through the center axis of the spherical knob 5. This knob 5 only, alternate post configuration, would probably be used where it is desirable to have minimal projection of a post above its fastening surface.

The catch 1 and post 2 may be made small or relatively large in size, depending on their application. They can be made to fit in recesses in opposing panels, so that only a small amount of the device elements project from panel surfaces. In this manner, the invention clasping device can be useful for quick access, removable panel constructions.

There are additional and likely uses for the invention clasping device for which the device can be easily adapted. Some of these applications are: (a), for securing a tool such as a mop, rake or shovel; (b), for temporarily locating and securing a small hanging lamp fixture; and (c), for securing hanging floral baskets. All of these applications require that the secured items be occasionally removed for use or servicing and then replaced. The adjustable grip and easy take apart or replace attributes of the invention clasping device, are fully responsive to the requirements of the foregoing applications.

The device parts are fabricated from a rigid, hard material and may be machined or formed, according to the material selected. Due to the small number and simplicity of the device parts, their manufacture is seen as being economic in quantity and therefore, relatively inexpensive.

As illustrated and described, the invention device is simple to install and use, economical to produce and may be sized to suit a number of applications requiring temporary, removable attachment of one item to another, besides entry and cabinet door applications.

From the foregoing description, it is believed that the preferred embodiment achieves the objects of the present invention. Various modifications and changes may be made to the adjustable grip, clasping device described above which are apparent to those skilled in the art. These alternatives and modifications are considered to be within the scope of the appended claims and are embraced thereby.

What is claimed is:

1. A clasping device, comprising:

(a) a rigid post having an elongate body, said body including a generally spherical shaped knob that is attached by a neck portion to one end of said body;

(b) first means for fastening said post to a firm, supporting surface;

(c) a catch for engaging said post, said catch comprising: a base member, said base member having a lower portion and a stepped, cylinder shaped upper portion, said upper portion including a flange which encircles the peripheral surface of said upper portion;

a cylindrical collar that is mounted on said base member for gripping said post; said collar being split longitudinally into two identical, equally sized collar sections; said collar sections including a circumferential ridge portion at each end, each said ridge portion projecting radially outward to form a stop and projecting radially inward to form a central circular grip bearing edge; said collar sections including a multiplicity of deep, circumferential first grooves cut in the outer peripheral surface of said collar sections that is located between said ridge portions; said collar sections including at one end, a deep circumferential second groove in the inner peripheral surface of a ridge portion, said second groove being sized and located to fit over and around said flange on the upper portion of said base member; said collar sections being sized to produce a slit opening between the longitudinal adjacent edges of each section when said collar sections are mounted on said base member with said second groove mated with said flange;

(d) second means for radially and expansibly holding said collar sections that are mounted to said upper portion of said base member, said second means acting as a spring clasp and fitting in one of said first grooves which are cut in the outer peripheral surface of said collar sections; said second means, when manually moved to a groove toward or further away from the collar end opening, causing said collar sections to pivot on said flange in a clamshell-like movement and to vary the diameter of the collar end opening, thereby adjusting the amount of clasping pressure that is applied to any post knob which is engaged by said catch; and, (e) third means for fastening said catch to a firm, supporting surface.

2. The clasping device according to claim 1 wherein, said second means for radially and expansibly holding said collar sections includes a steel split-ring formed of helical coil turns.

3. A clasping device, comprising:

a rigid post having an elongate body, said body including a generally spherical shaped knob that is attached by a neck portion to one end of said body;

first means for fastening said post to a firm, supporting surface;

a catch for engaging said post, said catch comprising: a base member, said base member having a lower portion and a stepped, cylinder shaped upper portion; and a split, cylindrical collar that is pivotally mounted for clamshell movement on said upper portion of said base member;

second means for fastening said catch to a firm, supporting surface; and, a spring clasp which fits over the outer peripheral surface of said collar and into one of a multiplicity of positional adjustment grooves cut in the surface of said collar; said spring clasp, when manually positioned in an adjustment groove nearer or further from the collar end opening, causing said collar to vary the diameter of the end opening in a clamshell-like movement and resulting in adjustment of the clasping pressure on any post knob that is engaged by said catch.

4. A clasping device, comprising:

a generally spherical shaped knob;

first means for fastening said knob to a firm, supporting surface;

a catch for engaging said knob, said catch comprising: a base member, said base member having a lower portion and a stepped, cylinder shaped upper portion; and a split, cylindrical collar that is pivotally mounted for clamshell movement on said upper portion of said base member;

second means for fastening said catch to a firm, supporting surface; and, a spring clasp which fits over the outer peripheral surface of said collar and into one of a multiplicity of positional adjustment grooves cut in the surface of said collar; said spring clasp, when manually positioned in an adjustment groove nearer or further from the collar end opening, causing said collar to vary the diameter of the end opening in a clamshell-like movement and resulting in adjustment of the clasping pressure on any said knob that is engaged by said catch.

* * * * *